US005689926A

United States Patent [19]

Nichols

[11] Patent Number: 5,689,926

[45] Date of Patent: Nov. 25, 1997

[54] MODULAR PANEL SYSTEM

[76] Inventor: Gregory Nichols, Box 3214, Nantucket, Mass. 02584

[21] Appl. No.: 539,420

[22] Filed: Oct. 5, 1995

[51] Int. Cl.[6] ..... E04B 1/00

[52] U.S. Cl. ..... 52/282.2; 52/239

[58] Field of Search ..... 52/301, 282.1, 52/282.2, 239, 36.1, 36.4, 736.3, 737.4, 738.1, 721.4, 723.1; 248/408, 412

[56] References Cited

U.S. PATENT DOCUMENTS

| | | | |
|---|---|---|---|
| 4,021,973 | 5/1977 | Hegg et al. | 52/239 X |
| 5,291,700 | 3/1994 | Chew | 52/36.4 X |
| 5,291,708 | 3/1994 | Johnson | 52/282.2 |
| 5,529,423 | 6/1996 | Burke et al. | 52/282.2 X |

*Primary Examiner*—Lanna Mai

*Attorney, Agent, or Firm*—Bromberg & Sunstein LLP

[57] ABSTRACT

A modular panel system for the purpose of partitioning spaces. The modular panel system includes at least one panel, and a plurality of panel supports. Each panel support includes a member, a cap at a first end, a base at a second end, and a panel retaining arrangement. The base is shaped to support the member in a free-standing upright position. The panel retaining arrangement serves to permit the attachment and removal of an appropriately configured edge of a vertically oriented panel between the cap and the base without the use of tools, and the rotational movement of the panel about an axis defined by the edge.

2 Claims, 4 Drawing Sheets

MODULAR PANEL SYSTEM

TECHNICAL FIELD

The present invention relates to space partition arrangements, and in particular to modular panel systems.

BACKGROUND ART

Modular panel systems for the purpose of partitioning spaces, such as offices and other areas, are well known in the art. Such systems typically require varying degrees of assembly in order to be used. It is common in the prior art, for example, to utilize a series of panels that are joined together at each panel intersection to a vertical support member by a series of brackets. Each bracket is secured by screws both to a panel and to a vertical support member. This design, while typically durable, is also relatively difficult to reconfigure, since each reorientation of panels with respect to one another requires removal and remounting of a number of brackets. Designs that avoid brackets typically involve other screw-mounted joining devices, such as hinges, which may permit some reconfiguration without removal of the joining devices. Nevertheless, devices of this nature still require disassembly for some kinds of reconfiguration. In addition, many prior art structures have relatively poor vertical stability, particularly when a series of panels is mounted to lie generally in a single plane.

SUMMARY OF THE INVENTION

The invention provides in a preferred embodiment a modular panel system having at least one panel; and a plurality of panel supports. Each panel support has (a) a member having first and second ends, (b) a base at the first end, (c) a cap disposed at the second end, and (d) a panel retaining arrangement. The base is shaped to support the member in a free-standing upright position. The panel retaining arrangement serves to removably retain an appropriately configured edge of a vertically oriented panel between the cap and the base so as to permit (i) the panel edge's attachment to, and removal from, the panel support without use of tools and (ii) rotational movement of the panel about an axis defined approximately by the edge.

In a further embodiment, the cap is shaped similarly to the base and symmetrically disposed with respect to the base, so that the member when inverted may be supported by the cap in a free-standing upright position. In addition, the panel retaining arrangement is realized by providing that the base and the cap each include an instance of one of (i) a spring-loaded element having a direction of travel that is parallel to the edge when the edge is being retained therein and (ii) a recess for receiving the spring-loaded element; furthermore, each end of the panel's edge includes an instance of the other of the spring-loaded element and the recess. The spring-loaded element may be a ball, for example, or may be equipped with a bullet-shaped head.

In this embodiment, each panel support has a vertical channel running between the cap and the base to receive the panel's edge. The panel's edge has a semicircular convex cross section and the channel has a corresponding concave cross section, so as to accommodate rotational movement of the panel about an axis defined approximately by the edge. Typically four such vertical channels and panel retaining arrangements may be provided in each panel support so as to permit a given panel support to receive and hold an edge of up to four panels. This configuration therefore permits up to four panels to be intersected at each support. This configuration also permits any two panels having adjacent edges to be mounted at right angles to each other and having opposed edges to be mounted in the same plane as one another.

The invention also provides a panel support of a similar nature.

BRIEF DESCRIPTION OF THE DRAWINGS

The foregoing features of the invention may be more readily understood by reference to the following detailed description taken with the accompanying drawings, in which.

DETAILED DESCRIPTION OF SPECIFIC EMBODIMENTS

Figure 1:
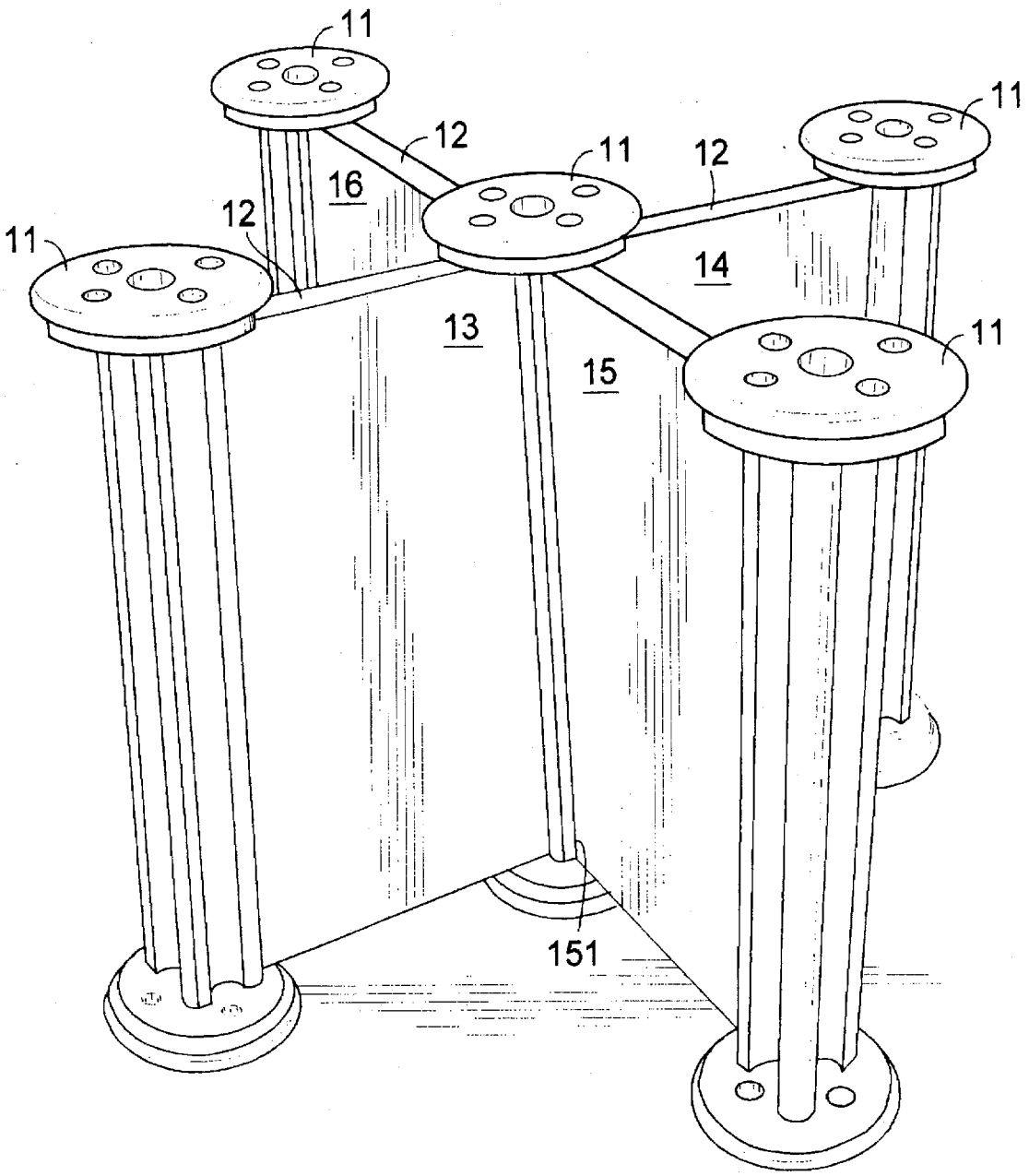
FIG. 1 is an isometric view of a modular panel system in accordance with a preferred embodiment of the invention.

FIG. 1 shows a modular panel system in accordance with a preferred embodiment of the invention. Shown in this figure are series of panel supports 11 that are used to support a series of panels 12. It can be seen that the panel supports 11 accommodate the panels in various geometries. Thus panels 13 and 14 are supported in a coplanar orientation, whereas panels 15 and 16 are disposed at an angle with respect to the panels 13 and 14. As will be described in more detail below, the system permits adjustment of the angles of panels with respect to one another. In particular, it is possible, for example to rotate panel 15 about an axis near its edge 151 that is retained in panel support 11. Each of the other panels 13 and 14 may be similarly rotated.

Figure 2:
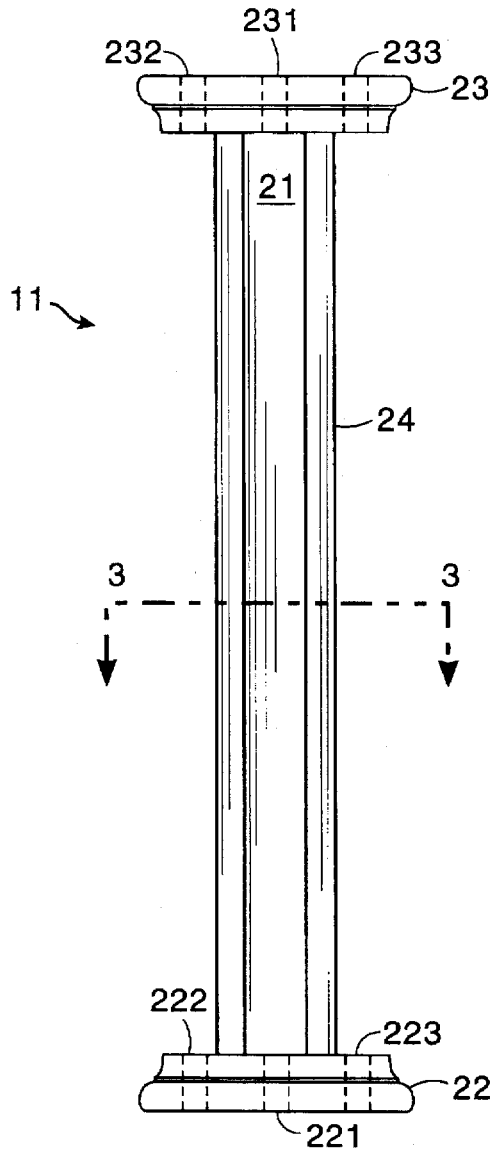
FIG. 2 is a side view of a panel support shown in FIG. 1.

FIG. 2 is a side view of a panel support 11 shown in FIG. 1. The panel support includes a member 24 that is supported on base 22 at one end and on the other end has a cap 23. The base 22 is of sufficient shape and dimension as to permit the support of the member 24 in a free-standing upright position. In this embodiment, the cap 23 has a shape similar to the base 22, and it is disposed symmetrically with respect to the base, so that when a member and its associated cap and base are inverted, the panel support may be supported by the cap in a free-standing upright position. The column 11 is arranged to removably retain an appropriately configured edge of panel 12 between the cap and the base so as to permit (i) the panel edge's attachment to, and removal from, the panel support 11 without the use of tools and (ii) while the panel's edge is retained by the panel support, rotational movement of the panel about an axis defined approximately by the edge. This structure is achieved by providing in the column 11 one or more pairs of oppositely disposed retaining arrangements in the base 22 and cap 23. Thus, one pair of such arrangements is identified as items 221 and 231 in the base 22 and 23 respectively. A line drawn through the center of these two locations defines the axis of rotational movement of the panel. The panel may be removably retained by providing a spring-loaded element at locations 231 and 221 facing inwardly in the direction of member 24, so that the spring element in location 221 is urged upwardly and the spring element in location 231 is urged downwardly. As described below in connection with FIG. 4, the spring-loaded elements mate with corresponding recesses in the panel at the ends of the edge that is retained. Alternatively, locations 221 and 231 may be equipped with recesses, and the spring-loaded elements may be incorporated in the corresponding panel locations. In any event, the column 11 includes other pairs of retaining arrangements, including those shown in FIG. 2 as 222 and 232 in the base and cap respectively, as well as 223 and 233. Associated with each pair of retaining arrangements is a vertical channel running between the base 22 and cap 23 to receive the edge of the panel. One such channel is identified in FIG. 2 as item 21, which is disposed between the pair of retaining arrangements 221 and 231.

Figure 3:
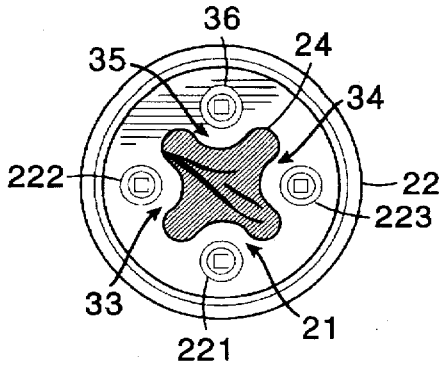
FIG. 3 shows a cross section of the panel support of FIG. 2 taken along line 3—3.

FIG. 3 is a cross section of the panel support 11 of FIG. 2 taken along line 3—3. The member 24 is shown in this figure, centrally disposed on base 22. It can be seen that the member 24 is provided with a total of four symmetrically disposed channels 21, 33, 35, and 34. With each channel there is associated a corresponding retaining arrangement 221, 222, 36 and 223 in base 22. The cap contains similar retaining arrangements in corresponding positions. The geometry permits a panel support to support panels that may be approximately coplanar or at right angles, or, thanks to the rotatability provided by the retaining arrangement, at any other angle.

Figure 4:
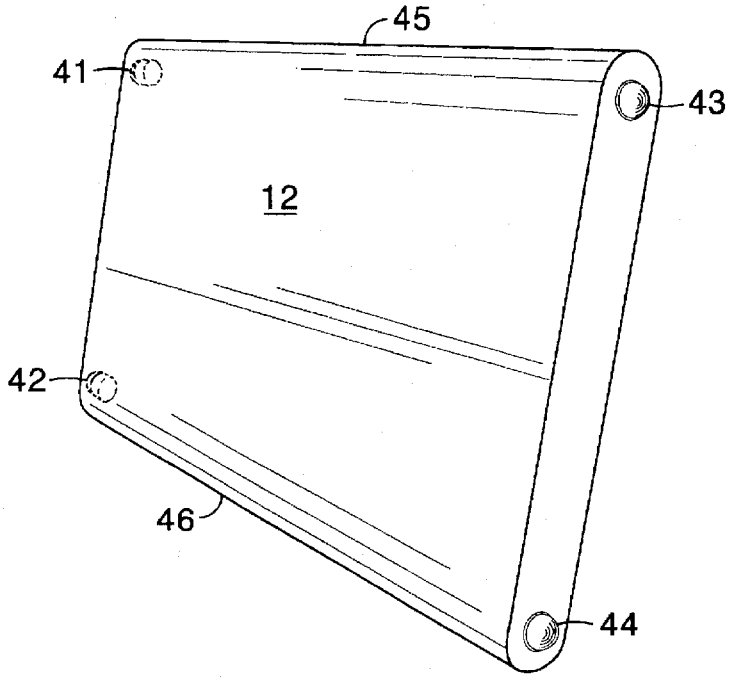
FIG. 4 is an isometric view of a panel shown in FIG. 1.

FIG. 4 is an isometric view of a panel 12 shown in FIG. 1. The panel has edges 45 and 46 that may be removably retained in a panel support 11 of the type shown in previous figures. At the ends of each edge 45 and 46 are pairs of spring-loaded elements at locations 41 and 43 (in the case of edge 45) and 42 and 44 (in the case of edge 46) respectively. As described in connection with the panel support 11 above, the spring-loaded element, in the pair of locations associated with an edge being inserted into a panel support 11, engages in a corresponding recess located in the base or cap (as the case may be) of the panel support. Alternatively, as described above, the spring-loaded element, may be located in each of the base and cap and the recess located in the ends of the panel's edge. It can be seen in FIG. 4 that each edge 45 and 46 of the panel 12 has a semicircular convex cross section that engages in the corresponding channel (21, 33, 35, or 34) of the panel support. In this manner, the panel may be rotated about an axis defined approximately by the edge that is retained in the panel support over a wide angle, while still showing an aesthetically smooth junction with the panel support. No air gaps are present at the junction.

Figure 5:
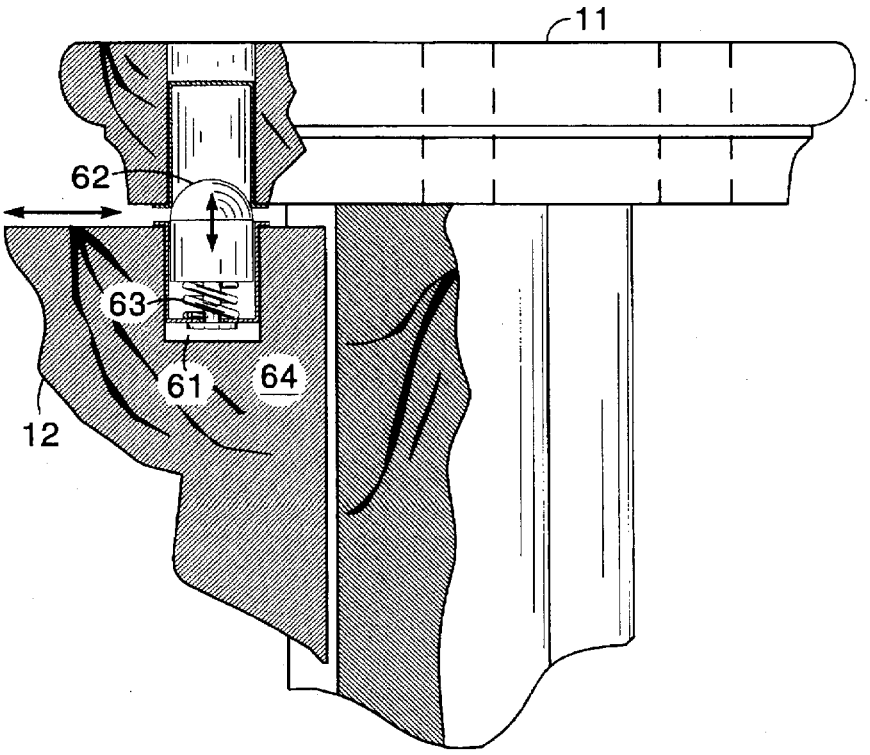
FIG. 5 is a partial sectional view of a portion of a panel and panel support of FIG. 1 showing a spring-loaded ball for engagement in a corresponding recess in the panel support.

FIG. 5 is a partial sectional view of a portion of a panel 12 and panel support 11 of FIG. 1 showing a spring-loaded bullet-headed member for engagement in a corresponding recess in a panel support. The bullet-headed member is shown as item 62, the spring is item 63, the recess is item 61, and the panel portion is shown as item 64. In a manner known in the art, the bullet-headed member is held captive in the recess by a suitable annular member mounted at the opening of the recess and through which a portion of the bullet-headed member protrudes. Alternatively, a ball in lieu of the bullet-headed member 62 of FIG. 5 may be used to engage the corresponding recess in the panel support 11. As described above, however, the spring-loaded member may be mounted in the panel support and corresponding recesses be located in the ends of the panel's edge.

Although a spring-loaded element has been shown in FIG. 5, it is also possible to use a wide range of other retaining arrangements for removably retaining the panel's edge. In particular, in lieu of a spring-loaded element, there may be provided a manually slidable bolt (similar to the type used in bolting a door), with a maintained latched position available by rotating the bolt around the axis on which it is ordinarily slid until a member disposed perpendicularly with respect to the bolt is engaged in retaining channel. Another possible arrangement may involve use of a threaded member that can be moved axially by rotation of a nut held captive in either the panel 12 or the panel support 11, so that the threaded member advances into a corresponding recess in the other of the panel 12 and panel support 11.

Figure 6:
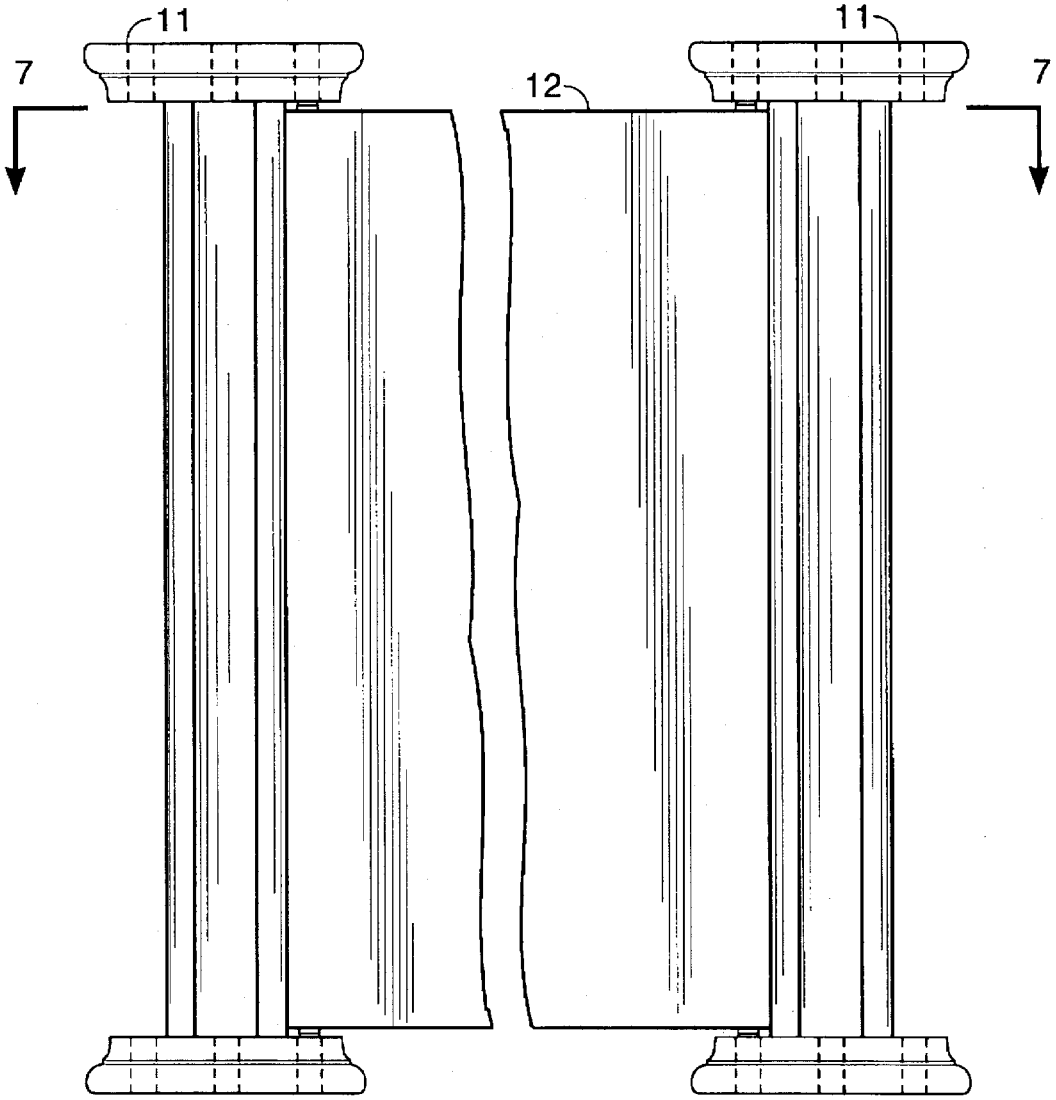
FIG. 6 is a front view of a portion of the modular panel system of FIG. 1 showing engagement of a panel with two panel supports.
Figure 7:
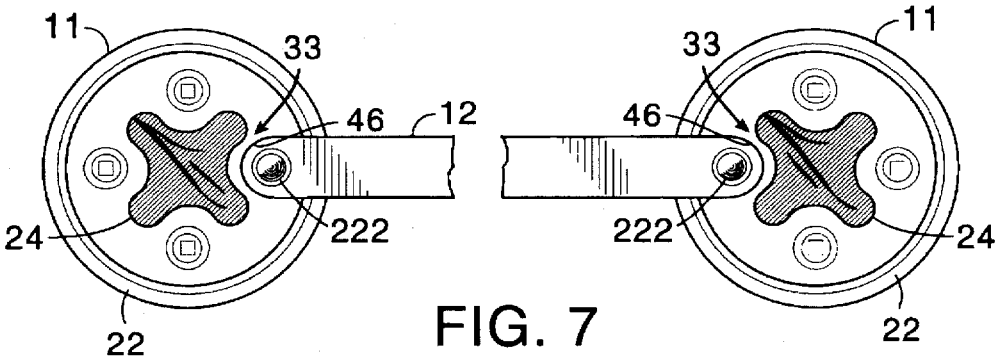
FIG. 7 is a cross section of FIG. 6 taken along line 7—7 showing engagement of the panel with the panel supports.

FIG. 6 is a front view of a portion of the modular panel system of FIG. 1 showing engagement of a panel 12 with two panel supports 11. It can be seen that the modular panel system of the present invention, in addition to the configuration shown in FIG. 1, may simply be arranged with just two panel supports 11 and a panel 12. Moreover, panel 12 may be of any proportionate length that may be supported between the two panel supports 11. FIG. 7 is a cross section of FIG. 6 taken along line 7—7 showing engagement of a panel 12 with the panel supports 11. Shown for each panel support 11 is the base 22, the member 24, the semicircular convex cross section 46 of the edge of the panel 12, the channel 33 (having a semicircular concave cross section) into which the edge 46 fits, along with the location 222 of the panel retaining arrangement.

The panel 12 and the panel support 11 may be formed from a wide variety of materials. In some embodiments it may be convenient, as well as attractive, to form these items from wood. However, it is also possible to use metal for all or a portion of these components, and a wide range of plastics may also be suitable.

What is claimed is:

1. A modular panel system comprising:

(a) at least one panel; and (b) a first plurality of panel supports, each panel support having:

(i) a member having first and second ends;

(ii) a base, disposed at the first end, shaped to support the member in a free-standing upright position;

(iii) a cap disposed at the second end; and (iv) panel retaining means, mounted in at least one of the cap and base, for removably retaining an appropriately configured edge of a vertically oriented panel between the cap and the base so as to permit (i) the panel edge's attachment to, and removal from, the panel support without use of tools and (ii) while the panel's edge is retained by the panel support, rotational movement of the panel about an axis defined approximately by the edge, wherein the panel retaining means includes, mounted in at least one of the base and the cap, one of (i) a spring-loaded element having a direction of travel that is parallel to the edge when the edge is being retained therein and (ii) a recess for receiving the spring-loaded element;

the panel's edge has two ends, and at least one end includes the other of the spring-loaded element and the recess;

the base and the cap each include one of (i) a spring-loaded element having a direction of travel that is parallel to the edge when the edge is being retained therein and (ii) a recess for receiving the spring-loaded element; and each end of the panel 's edge includes the other of the spring-loaded element and the recess.

2. A panel support, for a modular panel system, comprising:

(i) a member having first and second ends;

(ii) a base, disposed at the first end, shaped to support the member in a free-standing upright position;

(iii) a cap disposed at the second end; and (iv) a panel retaining means for removably retaining an appropriately configured edge of a vertically oriented panel between the cap and the base so as to permit (i) the panel edge's attachment to, and removal from, the panel support without use of tools and (ii) while the panel's edge is retained by the panel support, rotational movement of the panel about an axis defined approximately by the edge, wherein the panel retaining means includes, mounted in at least one of the base and cap, one of (i) a spring-loaded element having a direction of travel that is parallel to the edge when the edge is being retained therein and (ii) a recess for receiving the spring-loaded element; and the base and the cap each includes one of (i) a spring-loaded element having a direction of travel that is parallel to the edge when the edge is being retained therein and (ii) a recess for receiving the spring-loaded element.

* * * * *